US006338665B1

(12) United States Patent
Dawson et al.

(10) Patent No.: US 6,338,665 B1
(45) Date of Patent: Jan. 15, 2002

(54) PROTECTIVE BREAST COVERING ASSEMBLY

(76) Inventors: Sammie L. Dawson; Alice Dawson, both of 3411 N. 48thSt., Milwaukee, WI (US) 53216

( * ) Notice: Subject to any disclaimer, the term of this patent is extended or adjusted under 35 U.S.C. 154(b) by 0 days.

(21) Appl. No.: 09/705,637

(22) Filed: Nov. 3, 2000

(51) Int. Cl.[7] ..... A41C 3/00
(52) U.S. Cl. ..... 450/57; 450/39; 450/37
(58) Field of Search ..... 450/39, 37, 57, 450/36, 38; 2/2.5, 267; 604/346; 623/7, 8, 11, 17

(56) References Cited

U.S. PATENT DOCUMENTS

| | | | | | |
|---|---|---|---|---|---|
| 146,805 | A | * | 1/1874 | Cox | 450/37 |
| 2,044,913 | A | * | 6/1936 | Miller | 450/37 |
| D141,777 | S | * | 7/1945 | Ferguson | 450/37 |
| 2,454,535 | A | | 11/1948 | Warner | |
| 2,505,458 | A | | 4/1950 | Brauer | |
| 2,630,119 | A | * | 3/1953 | Aagesen | 450/37 |
| 2,896,623 | A | * | 7/1959 | Fitzgerald | 450/37 |
| 3,301,254 | A | * | 1/1967 | Schickedanz | 450/37 |
| 3,840,012 | A | * | 10/1974 | Rushton, Jr. | 450/37 |
| 4,270,538 | A | * | 6/1981 | Murphy | 450/37 |
| D321,058 | S | | 10/1991 | Dickinson | |
| 5,326,305 | A | | 7/1994 | Fochler | |
| D364,250 | S | | 11/1995 | Mccracken et al. | |
| 5,522,892 | A | | 6/1996 | Lin | |
| 5,782,672 | A | * | 7/1998 | Woodley | 450/57 |
| 5,806,103 | A | | 9/1998 | Mccracken et al. | |
| 6,183,340 | B1 | * | 2/2001 | Wen | 450/5 X |
| 6,241,715 | B1 | * | 6/2001 | Houser et al. | 450/37 X |

* cited by examiner

*Primary Examiner*—Gloria M. Hale

(57) ABSTRACT

A protective breast covering assembly for protecting a breast from the surrounding environment after a surgical procedure or other event. The protective breast covering assembly includes a breast covering assembly, which includes a cup member that includes an opening and a lip extending outwardly from a periphery of the opening of the cup member. An adhesive is coupled to a first face of the lip whereby the lip is designed to be coupled to a portion of skin surrounding a breast such that the cup member covers the breast.

10 Claims, 3 Drawing Sheets

PROTECTIVE BREAST COVERING ASSEMBLY

BACKGROUND OF THE INVENTION

1. Field of the Invention

The present invention relates to breast protectors and more particularly pertains to a new protective breast covering assembly for protecting a breast from the surrounding environment after a surgical procedure or other event.

2. Description of the Prior Art

The use of breast protectors is known in the prior art. More specifically, breast protectors heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 5,806,103; 5,522,892; 2,454,535; U.S. Pat. No. Des. 321,058; U.S. Pat. Nos. 5,326,305; 2,505,458; and U.S. Pat. No. Des. 364,250.

While these devices fulfill their respective, particular objectives and requirements, the aforementioned patents do not disclose a new protective breast covering assembly. The inventive device includes a breast covering assembly, which includes a cup member that includes an opening and a lip extending outwardly from a periphery of the opening of the cup member. An adhesive is coupled to a first face of the lip whereby the lip is designed to be coupled to a portion of skin surrounding a breast such that the cup member covers the breast.

In these respects, the protective breast covering assembly according to the present invention substantially departs from the conventional concepts and designs of the prior art, and in so doing provides an apparatus primarily developed for the purpose of protecting a breast from the surrounding environment after a surgical procedure or other event.

SUMMARY OF THE INVENTION

In view of the foregoing disadvantages inherent in the known types of breast protectors now present in the prior art, the present invention provides a new protective breast covering assembly construction wherein the same can be utilized for protecting a breast from the surrounding environment after a surgical procedure or other event.

The general purpose of the present invention, which will be described subsequently in greater detail, is to provide a new protective breast covering assembly apparatus and method which has many of the advantages of the breast protectors mentioned heretofore and many novel features that result in a new protective breast covering assembly which is not anticipated, rendered obvious, suggested, or even implied by any of the prior art breast protectors, either alone or in any combination thereof.

To attain this, the present invention generally comprises a breast covering assembly, which includes a cup member that includes an opening and a lip extending outwardly from a periphery of the opening of the cup member. An adhesive is coupled to a first face of the lip whereby the lip is designed to be coupled to a portion of skin surrounding a breast such that the cup member covers the breast.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new protective breast covering assembly apparatus and method which has many of the advantages of the breast protectors mentioned heretofore and many novel features that result in a new protective breast covering assembly which is not anticipated, rendered obvious, suggested, or even implied by any of the prior art breast protectors, either alone or in any combination thereof.

It is another object of the present invention to provide a new protective breast covering assembly, which may be easily and efficiently manufactured and marketed.

It is a further object of the present invention to provide a new protective breast covering assembly, which is of a durable and reliable construction.

An even further object of the present invention is to provide a new protective breast covering assembly which is susceptible of a low cost of manufacture with regard to both materials and labor, and which accordingly is then susceptible of low prices of sale to the consuming public, thereby making such protective breast covering assembly economically available to the buying public.

Still yet another object of the present invention is to provide a new protective breast covering assembly which provides in the apparatuses and methods of the prior art some of the advantages thereof, while simultaneously overcoming some of the disadvantages normally associated therewith.

Still another object of the present invention is to provide a new protective breast covering assembly for protecting a breast from the surrounding environment after a surgical procedure or other event.

Yet another object of the present invention is to provide a new protective breast covering assembly which includes a breast covering assembly, which includes a cup member that includes an opening and a lip extending outwardly from a periphery of the opening of the cup member. An adhesive is coupled to a first face of the lip whereby the lip is designed to be coupled to a portion of skin surrounding a breast such that the cup member covers the breast.

Still yet another object of the present invention is to provide a new protective breast covering assembly that covers a users breast and protects it from clothing, water and pressures that impact on the breast or cysts on the breast.

Even still another object of the present invention is to provide a new protective breast covering assembly that provides a protective covering for the breast while also providing the user with a natural look and comfortable fit.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
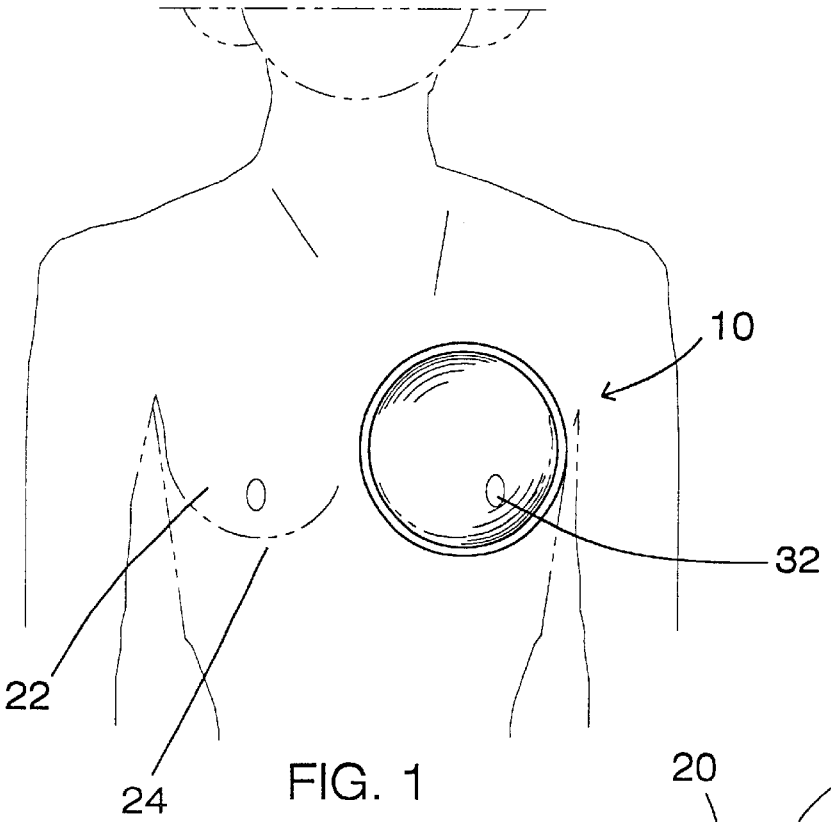
FIG. 1 is a perspective view of a new protective breast covering assembly according to the present invention.
Figure 2:
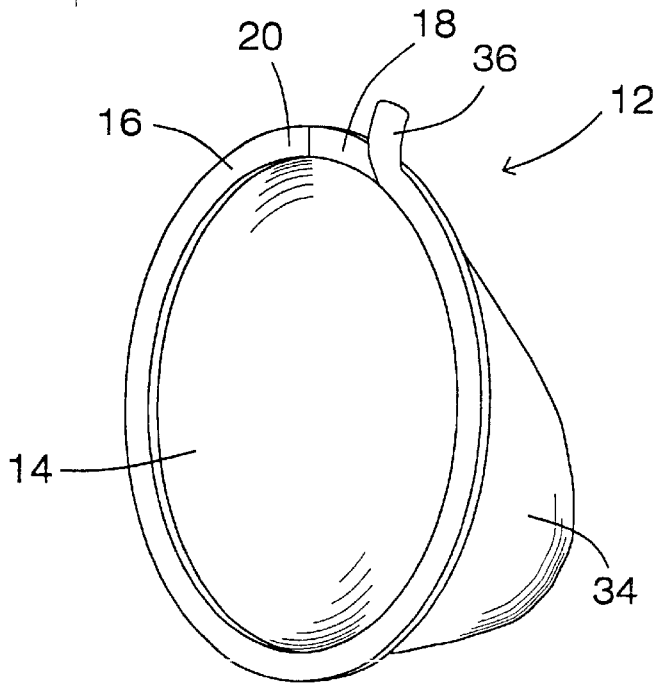
FIG. 2 is a perspective view of the present invention.
Figure 3:
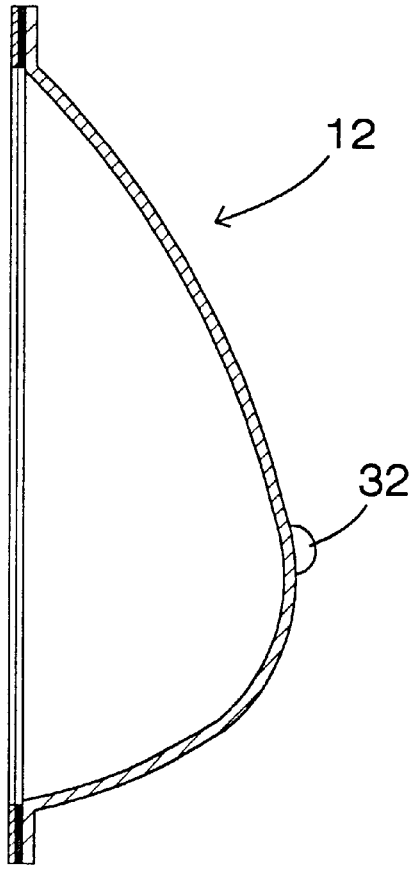
FIG. 3 is a side cutaway view of the present invention.
Figure 4:
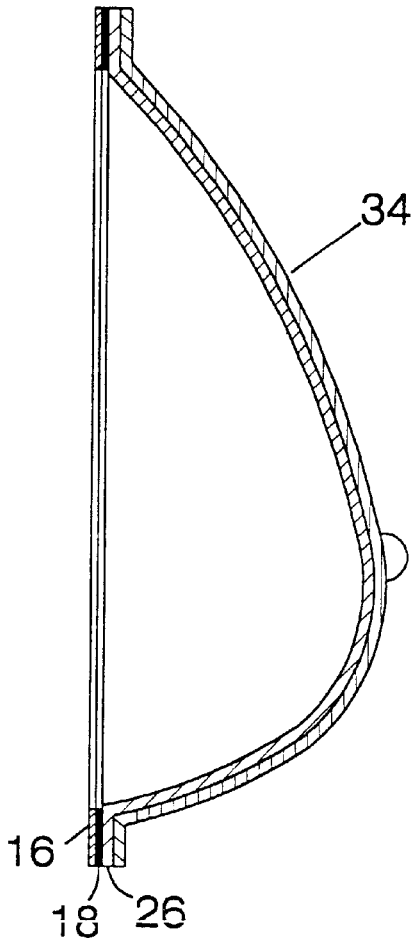
FIG. 4 is a side cutaway view of the present invention.
Figure 5:
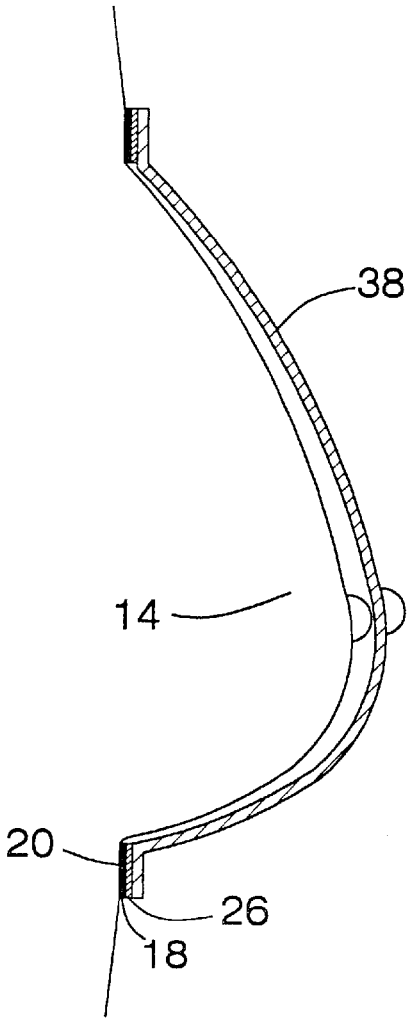
FIG. 5 is a side view of the present invention.
Figure 6:
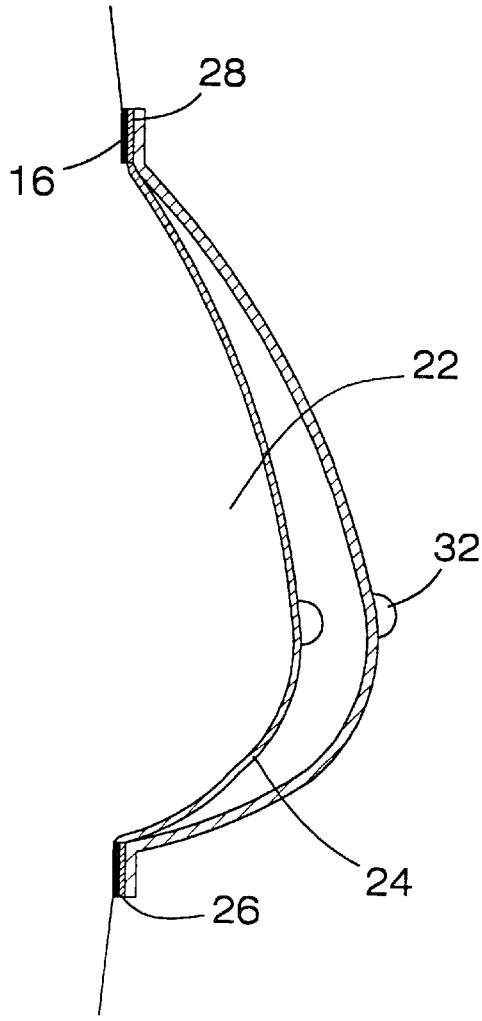
FIG. 6 is a side view of the present invention.

With reference now to the drawings, and in particular to FIGS. 1 through 6 thereof, a new protective breast covering assembly embodying the principles and concepts of the present invention and generally designated by the reference numeral 10 will be described.

As best illustrated in FIGS. 1 through 6, the protective breast covering assembly 10 generally includes a cup member 12, which includes an opening 14 and a lip 16 extending outwardly from a periphery of the opening of the cup member 12. An adhesive 18 is coupled to a first face 20 of the lip 16 whereby the lip 16 is designed to be coupled to a portion of skin 24 surrounding a breast 22 such that the cup member 12 covers the breast 22.

The adhesive 18 forms a continuous band of adhesive 18 around the lip 16 for preventing moisture from entering the cup member 12 between the lip 16 and the skin 24 surrounding the breast 22 when the cup member 12 is coupled to the skin 24 surrounding the breast 22 such that the breast 22 is covered by the cup member 12.

An annular foam pad 26 includes a first face 28 coupled to the lip 16. The adhesive 18 is coupled to a second face 30 of the foam pad 26 such that the foam pad 26 is positioned between the lip 16 and the skin 24 surrounding the breast 22 when the adhesive 18 is coupled to the skin 24 surrounding the breast 22 such that the cup member 12 covers the breast 22. In an embodiment a foam pad 26 that provides a cushion between the inside of the cup member 12 and the users breast 22.

A protrusion 32 is positioned on an outwardly facing surface 34 of the cup member 12 when the cup member 12 is coupled to the skin 24 surrounding the breast 22 such that the cup member 12 covers the breast 22. The protrusion 32 resembling a nipple whereby the cup member 12 is designed for providing a natural appearance when a user wears the breast cup.

A backing member 36 is removably coupled to the adhesive 18 for protecting the adhesive 18 prior to removal of the backing member 36.

The cup member 12 is constructed from a material chosen from the group of materials consisting of natural rubber and synthetic rubber. The cup member 12 includes a cup portion 38 extending from the lip 16 to be positioned in spaced relationship to the breast 22 when the cup member 12 is coupled to the skin 24 surrounding the breast 22. The cup portion 38 is designed for permitting prevention of direct contact with the breast 22 when the breast 22 is sensitive.

The cup member 12 is waterproof for preventing absorption of water through the cup member 12 whereby the cup member 12 is designed for permitting prevention of moisture contamination of a wound on the breast 22.

In use, a user would peal off the adhesive backing and place the breast cup assembly over the desired breast. The user would properly position the breast cup over the breast before applying pressure to the lip of the breast cup to seal the cup around the breast.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A breast covering assembly comprising:

a cup member having an opening and a lip extending outwardly from a periphery of said opening of said cup member;

an adhesive coupled to a first face of said lip whereby said lip is adapted for coupling to a portion of skin surrounding a breast such that said cup member covers the breast; and said cup member being waterproof for preventing absorption of water through said cup member whereby said cup member is adapted for permitting prevention of moisture contamination of a wound on the breast.

2. The breast covering assembly of claim 1, further comprising:

said adhesive forming a continuous band of adhesive around said lip for preventing moisture from entering said cup member between said lip and the skin surrounding the breast when the cup member is coupled to the skin surrounding the breast such that the breast is covered by the cup member.

3. The breast covering assembly of claim 1, further comprising:

a foam pad having a first face coupled to said cup member, said adhesive being coupled to a second face of a perimeter portion of said foam pad such that said perimeter portion of said foam pad is positioned between said lip and the skin surrounding the breast when said adhesive is coupled to the skin surrounding the breast such that said cup member covers the breast.

4. The breast covering assembly of claim 1, further comprising:

a protrusion positioned on an outwardly facing surface of said cup member when said cup member is coupled to the skin surrounding the breast such that said cup member covers the breast, said protrusion resembling a nipple whereby said cup member is adapted for providing a natural appearance when said breast cup is worn by a user.

5. The breast covering assembly of claim 1, further comprising:

a backing member removably coupled to said adhesive for protecting said adhesive prior to removal of said backing member.

6. The breast covering assembly of claim 1, further comprising:

said cup member being constructed from a material chosen from the group of materials consisting of natural rubber and synthetic rubber.

7. The breast covering assembly of claim 1, further comprising:

said cup member having a cup portion extending from said lip for positioning in spaced relationship to the breast when the cup member is coupled to the skin surrounding the breast whereby said cup portion is adapted for permitting prevention of direct contact with the breast when the breast is sensitive.

8. The breast covering assembly of claim 1, further comprising:

an annular foam pad having a first face coupled to said lip, said adhesive being coupled to a second face of said foam pad such that said foam pad is positioned between said lip and the skin surrounding the breast when said adhesive is coupled to the skin surrounding the breast such that said cup member covers the breast.

9. A breast covering assembly comprising:

a cup member having an opening and a lip extending outwardly from a periphery of said opening of said cup member;

an adhesive coupled to a first face of said lip whereby said lip is adapted for coupling to a portion of skin surrounding a breast such that said cup member covers the breast;

said adhesive forming a continuous band of adhesive around said lip for preventing moisture from entering said cup member between said lip and the skin surrounding the breast when the cup member is coupled to the skin surrounding the breast such that the breast is covered by the cup member;

a foam pad having a first face coupled to said cup member, said adhesive being coupled to a second face of a perimeter portion of said foam pad such that said perimeter portion of said foam pad is positioned between said lip and the skin surrounding the breast when said adhesive is coupled to the skin surrounding the breast such that said cup member covers the breast;

a protrusion positioned on an outwardly facing surface of said cup member when said cup member is coupled to the skin surrounding the breast such that said cup member covers the breast, said protrusion resembling a nipple whereby said cup member is adapted for providing a natural appearance when said breast cup is worn by a user;

a backing member removably coupled to said adhesive for protecting said adhesive prior to removal of said backing member;

said cup member being constructed from a material chosen from the group of materials consisting of natural rubber and synthetic rubber;

said cup member having a cup portion extending from said lip for positioning in spaced relationship to the breast when the cup member is coupled to the skin surrounding the breast whereby said cup portion is adapted for permitting prevention of direct contact with the breast when the breast is sensitive; and said cup member being waterproof for preventing absorption of water through said cup member whereby said cup member is adapted for permitting prevention of moisture contamination of a wound on the breast.

10. A breast covering assembly comprising:

a cup member having an opening and a lip extending outwardly from a periphery of said opening of said cup member;

an adhesive coupled to a first face of said lip whereby said lip is adapted for coupling to a portion of skin surrounding a breast such that said cup member covers the breast;

said adhesive forming a continuous band of adhesive around said lip for preventing moisture from entering said cup member between said lip and the skin surrounding the breast when the cup member is coupled to the skin surrounding the breast such that the breast is covered by the cup member;

an annular foam pad having a first face coupled to said lip, said adhesive being coupled to a second face of said foam pad such that said foam pad is positioned between said lip and the skin surrounding the breast when said adhesive is coupled to the skin surrounding the breast such that said cup member covers the breast;

a protrusion positioned on an outwardly facing surface of said cup member when said cup member is coupled to the skin surrounding the breast such that said cup member covers the breast, said protrusion resembling a nipple whereby said cup member is adapted for providing a natural appearance when said breast cup is worn by a user;

a backing member removably coupled to said adhesive for protecting said adhesive prior to removal of said backing member;

said cup member being constructed from a material chosen from the group of materials consisting of natural rubber and synthetic rubber;

said cup member having a cup portion extending from said lip for positioning in spaced relationship to the breast when the cup member is coupled to the skin surrounding the breast whereby said cup portion is adapted for permitting prevention of direct contact with the breast when the breast is sensitive; and said cup member being waterproof for preventing absorption of water through said cup member whereby said cup member is adapted for permitting prevention of moisture contamination of a wound on the breast.

* * * * *